US005292131A

United States Patent [19]

Takemoto et al.

[11] Patent Number: 5,292,131

[45] Date of Patent: Mar. 8, 1994

[54] CURTAIN PANEL ASSEMBLY FOR GAME MACHINE ISLAND

[75] Inventors: Takatoshi Takemoto; Toshikazu Chida, both of Tokyo; Yoshihide Kurihara, Hanamaki, all of Japan

[73] Assignee: Kabushiki Kaisha Ace Denken, Tokyo, Japan

[21] Appl. No.: 17,902

[22] Filed: Feb. 16, 1993

[30] Foreign Application Priority Data

Feb. 24, 1992 [JP] Japan ..... 4-36389

[51] Int. Cl.[5] ..... A63F 7/02; A63F 7/36

[52] U.S. Cl. ..... 273/148 R; 273/121 B; 312/116; 312/227

[58] Field of Search ..... 273/121 B, 376, 148 R, 273/143 R; 312/116, 224, 227

[56] References Cited

FOREIGN PATENT DOCUMENTS 0054744 5/1979 Japan ..... 273/121 B 3272788 12/1991 Japan ..... 273/121 B

*Primary Examiner*—Benjamin H. Layno

*Attorney, Agent, or Firm*—Lowe, Price, LeBlanc & Becker

[57] ABSTRACT

A curtain panel assembly, for an island of game machines, which enables any person of the amusement arcade to look into the island easily and quickly to check the states of game mediums in a distribution gutter situated in the upper part of a support frame of the island or for the purpose of maintenance of the interior structure of the island. In the curtain panel assembly, a curtain panel is mounted on the upper part of the support frame outwardly thereof and is pivotally connected at its upper edge to the upper frame edge. The curtain panel has on its inside wall surface a mirror on which the image of the interior, e.g. the distribution gutter, of the island is reflected so as to be observed from outside when the curtain panel is moved angularly about the upper panel edge to open as the lower panel edge is pulled upwardly.

5 Claims, 5 Drawing Sheets

CURTAIN PANEL ASSEMBLY FOR GAME MACHINE ISLAND

BACKGROUND OF THE INVENTION

1. Field of the Invention

This invention relates to a curtain panel assembly for concealing the interior of a game machine island including a support frame on which a plurality of game machines are mounted in array, and a distribution gutter situated in and along an upper part of the support frame and extending over the game machines, the curtain panel assembly being adapted to be mounted outside on the upper part of the support frame.

2. Description of the Related Art

The conventional type curtain panel assembly of a game machine island comprises a plurality of decorative plates mounted on the upper part of a support frame, on which a plurality of game machines such as pachinko or slot machines are arranged, thus concealing the interior structures, e.g. a distribution gutter situated in and along the upper part of the support frame over the individual game machines, so as not to be seen from outside, which improves things from an aesthetic view point.

This curtain panel assembly can be opened at required so as to be able to look into the interior of the island for checking the status (e.g., clogged) of game mediums such as pachinko balls, tokens or coins or for maintenance of the interior structure of the island.

However, in the conventional game machine island, since the upper part of the island is generally located at a position higher than the height of a person, anyone who looks inside the island to check or carry out maintenance to the distribution gutter or any other internal structures of the island, will be unable to open the decorative plate to look into the island unless they use portable steps to climb up.

SUMMARY OF THE INVENTION

It is therefore an object of this invention to provide a curtain panel assembly, for an island of game machines, which allows the person to look into the island easily and quickly for checking the status of game mediums in a distribution gutter situated in and along the upper part of a support frame or for maintenance of other interior structures of the island.

Accordingly, this invention provides a curtain panel assembly for concealing the interior of a game machine island including a support frame on which a plurality of game machines are mounted in array, and a distribution gutter situated in and along an upper part of the support frame and extending over the game machines, the curtain panel assembly comprising: a curtain panel adapted to be openably mounted on the upper part of the support frame at an outside thereof; the curtain panel having an upper edge adapted to be pivotally connected to an upper edge of the support frame; and the curtain panel having on its inside wall surface a mirror on which the image of the interior of the island including the distribution gutter is reflected so as to be observed from outside when the curtain panel is angularly moved about the upper panel edge when it is opened by pulling the lower edge of the curtain panel upwardly.

Preferably, the curtain panel has a curved surface bulging outwardly as viewed in vertical cross section, and the mirror is a concave mirror along the concave inside wall surface of the curtain panel.

Further, the curtain panel may have between its inside and outside walls a hollow in which a light source is located, the mirror may be positioned on the inside wall, and the outside wall may be a transparent decorative illumination plate.

The curtain panel assembly may additionally include support arms for supporting the curtain panel in an open position as the lower panel edge is pulled upwardly to angularly move about the upper panel edge.

Furthermore, the curtain panel may be divided into a plurality of panel units adapted to be arranged longitudinally along the upper part of the support frame at an outside thereof in such a manner that each of the panel units corresponds to one or more of the game machines.

Normally, the curtain panel assumes a closed posture to conceal the interior structure, e.g. the distribution gutter situated in the upper part of the support frame over the individual game machines, so as not to be seen from outside, making the amusement arcade tidy.

By raising its lower panel edge to move angularly about its upper panel edge, it is possible to open the curtain panel for checking the status of the game mediums flowing in the distribution gutter or for maintenance of other interior structures of the island.

When the curtain panel is thus opened, the image of the distribution gutter is reflected in the mirror on the inside wall surface of the panel so that the person can grasp the current status of game mediums in the distribution gutter at a glance. It is possible to observe the distribution gutter located in the upper part of the island generally at a position higher than the height of a person easily and quickly, without using portable steps.

Since with the mirror of the opened curtain panel, the status of game mediums in the distribution gutter as well as other interior structures of the island can be observed from a lower position easily and quickly, it is possible to easily perform maintenance of the interior structure of the island. If the curtain panel assembly has the support arms for supporting the curtain panel in an open position, it is possible to grasp the status of game mediums in the distribution gutter and other interior structures of the island by the mirror of the curtain panel without opening and closing the curtain panel repeatedly, thus realizing effective maintenance of the interior structure of the island.

If the curtain panel has a curved surface bulging outwardly as viewed in vertical cross section, and the mirror is a concave mirror along the concave inside wall surface of the curtain panel, it is possible to present an original appearance. Further, because of the concave mirror along the concave inside wall surface of the curtain panel, it is possible to observe the distribution gutter and other interior structures of the island on an enlarged scale and so in more detail.

If the curtain panel has between inside and outside walls, a hollow in which a light source is located, if the mirror is positioned on the inside wall and also if the outside wall is a transparent decorative illumination plate, it is possible to make the game machine island decorative more efficiently. Furthermore, if the curtain panel is divided into a plurality of panel units adapted to be arranged longitudinally along the upper part of the support frame at the outside thereof in such a manner that each of the panel units corresponds to one or more of the game machines, it is possible to assemble the game machine island efficiently.

DETAILED DESCRIPTION

Figure 1:
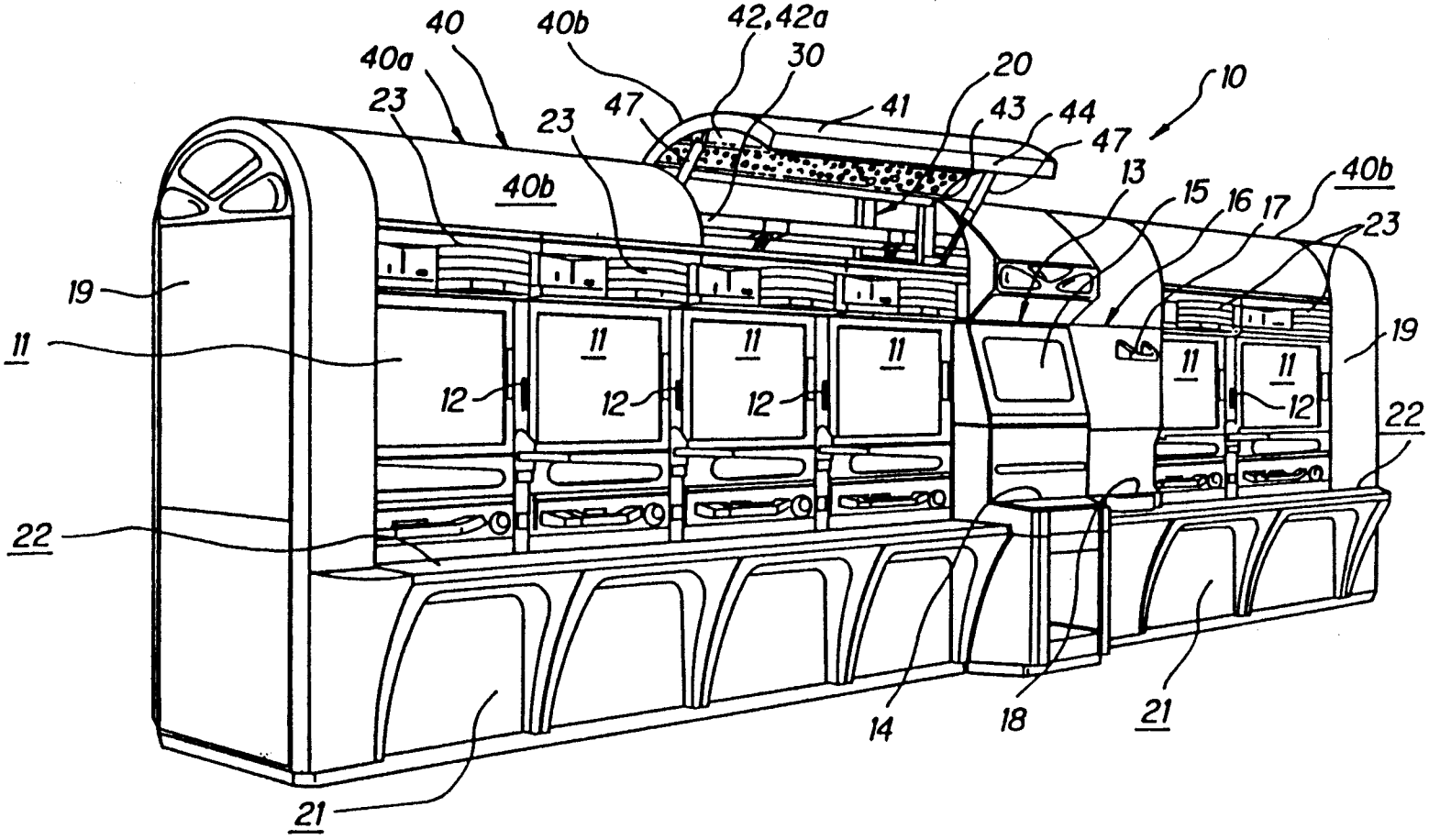
FIG. 1 is a perspective view of a game machine island in which a curtain panel assembly according to a first embodiment of this invention is incorporated.

Embodiments of this invention will now be described with reference to the accompanying drawings. Like reference numerals designate similar parts or elements throughout the different embodiments, and any repetition of description is omitted from the following description.

FIGS. 1 through 4 show a first embodiment of this invention.

Figure 2:
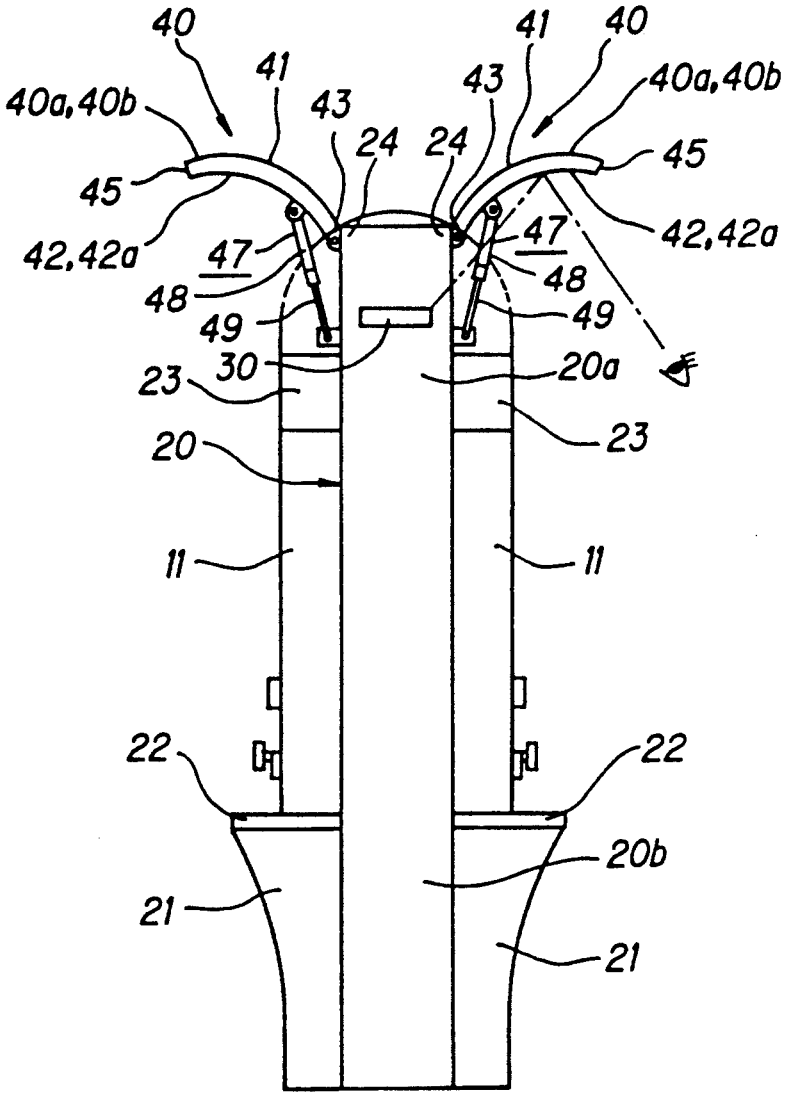
FIG. 2 is a side view of the game machine island of FIG. 1.

As shown in FIGS. 1 and 2, outside the lower part 20*b* of a support frame 20 which constructs a game machine island 10, a skirt panel unit 21 is attached. A shelf plate 22 is fixed to the top of the skirt panel unit 21. At opposite surfaces of the support frame 20 on the shelf plate 22, a plurality of game machines such as pachinko game machines 11 are installed in two arrays, there being installed a ball dispenser 12 between each adjacent pair of pachinko game machines 11, 11.

Between a pair of adjacent pachinko game machines 11, 11 which are located substantially centrally of each game machine array of the island, a pachinko ball counter 13 and a money exchanger 16 are installed. The pachinko ball counter 13 includes a built-in computer for counting the number of pachinko balls inserted into the counter 13 from an inlet 14, and a counted-number number display 15 for displaying the result of this counting. The money exchanger 16 has on its front side a paper-currency insertion slot 17 and a paper-currency return slot 18. An island decoration 19 is installed at each end of the support frame 20.

A plurality of warning lamps 23 are attached to the upper part 20*a* of the support frame 20, which are located upwardly of the individual pachinko machines 11, so as to correspond to the respective pachinko machines 11. The warning lamp 23 will be turned on when the associated pachinko game machine 11 distributes a large number of pachinko balls at one time as a prize to a player or gets in an abnormal states, giving such a notice to the clerk of the amusement arcade. A distribution gutter 30 is situated in and along the upper part 20*a* of the support frame 20 above the warning lamps 23, extending over the individual pachinko game machines 11. The distribution gutter 30 supplies pachinko balls A to the individual pachinko game machines 11.

A curtain panel assembly 40 is mounted on the uppermost part of the support frame 20 outwardly thereof for concealing the internal structure of the upper island part including the distribution gutter 30. The curtain panel assembly 40 chiefly comprises a curtain panel 40*a* openably mounted on the upper part 20 of the support frame 20. The curtain panel 40*a* has between upper and lower edges 43, 45 a curved surface bulging outwardly as viewed in vertical cross section.

Figure 3:
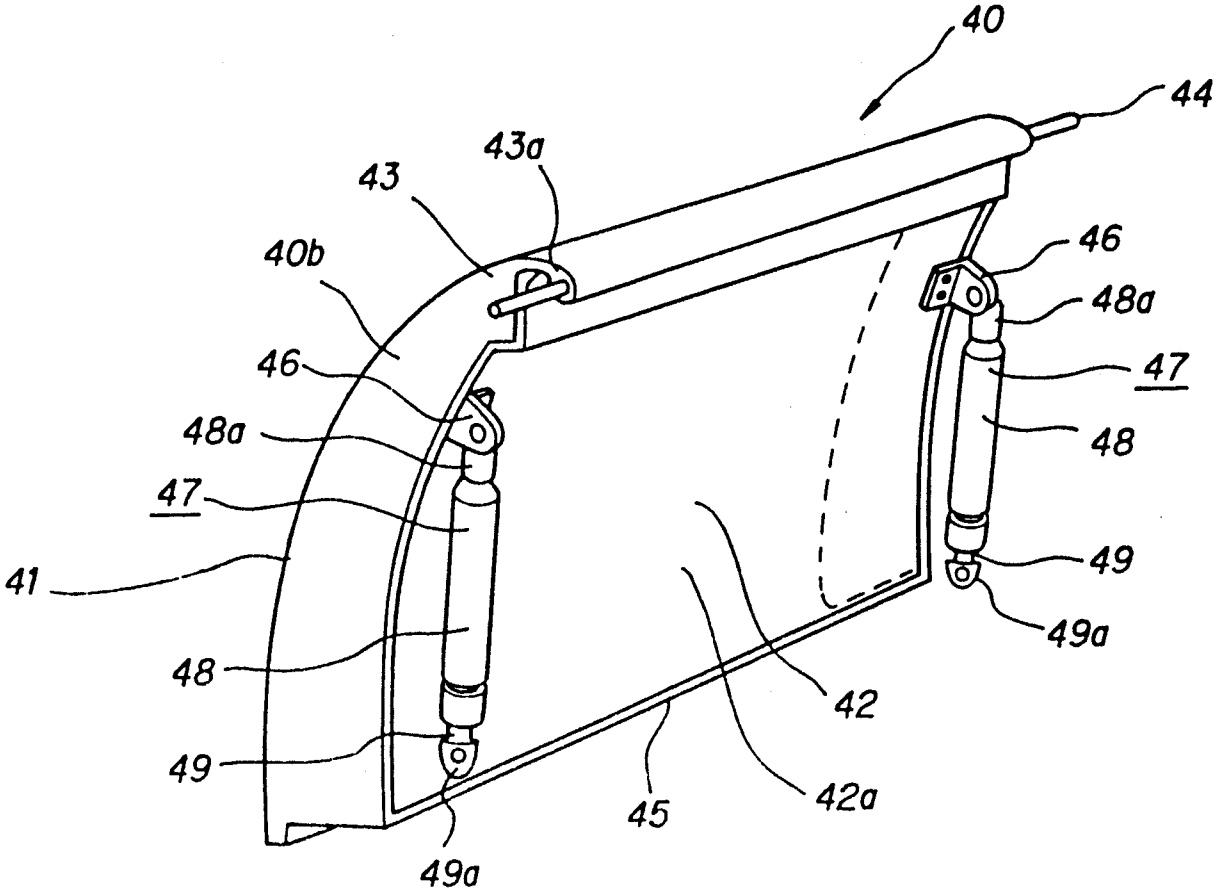
FIG. 3 is a perspective view of a panel unit of the curtain panel assembly of the first embodiment.
Figure 4:
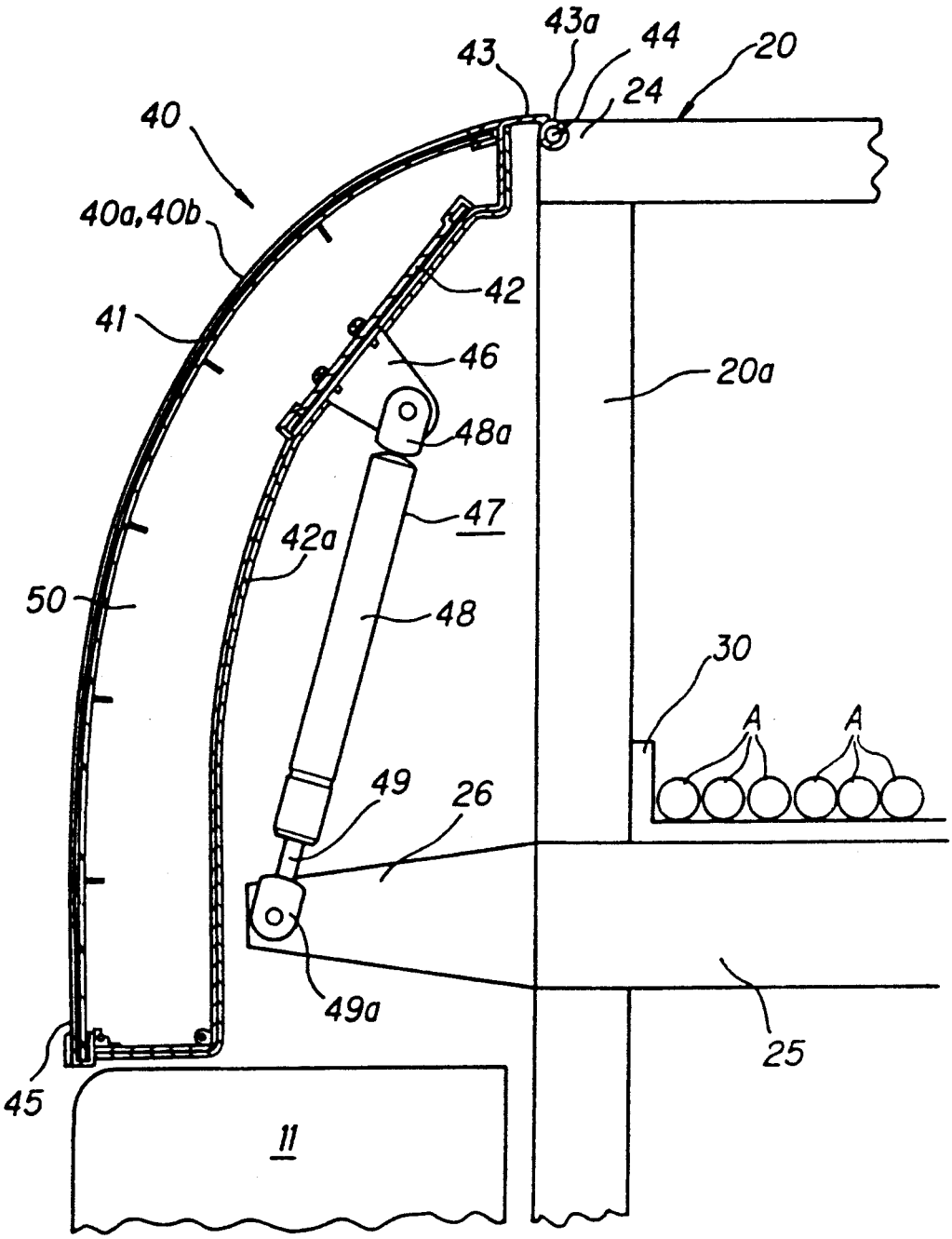
FIG. 4 is a cross-sectional view of the panel unit of FIG. 3.

The curtain panel 40*a*, as shown in FIG. 1 and 3, is divided into a plurality of panel units 40*b* each having a horizontal length corresponding to the total width of two adjacent pachinko game machines 11, 11. The panel units 40*b* are arranged on and along the the upper part 20*a* of the support frame 20 outwardly thereof. As shown in FIGS. 3 and 4, the panel unit 50 has between inside and outside walls 42, 41 a hollow 50, opposite ends of which are covered by end caps.

The panel unit 40*b* has along its upper edge 43 a pivoting portion 43*a* through which a pivot rod 44 is inserted. The panel unit 40*b* is pivotally connected along the upper edge 24 of the support frame 20 by the pivot rod 44. When the lower edge 45 of the panel unit 40*b* is raised about the pivoting portion 43*a* to open the panel unit 40*b*, a mirror 42*a* is formed integrally on the entire surface of the inside wall 42 so that the image of the interior of the island including the distribution gutter 30 can be reflected on the inside wall 42. The mirror 42*a* is a concave mirror in the form of, for example, a polished stainless steel plate curved along the concave inside wall 42.

As shown in FIGS. 2 through 4, a pair of support arms 47, 47 are pivotally connected to opposite ends of the panel unit 40*b* via a pair of attachment brackets 46, 46, respectively. The support arm 47 serves to hold the panel unit 40*b* in an open position with the lower edge 45 raised about the pivoting portion 43*a*.

More specifically, the support arm 47 includes a tubular member 48 connected at its pivot 48*a* to the inside wall 42 via the attachment bracket 46, and a rod-like member 49 projectably inserted into the tubular member 48.

As the rod-like member 49 is projected from and retracted into the tubular member 48, the support arm 47 will be expanded and contracted. The rod-like member 49 is pivotally connected at its pivot 49*a* to the upper part 20*a* of the support frame 20 via a supporting bracket 26. The support arm 47 will be expanded as shown in FIG. 2 while the panel unit 40*b* is opened, and will be contracted as shown in FIG. 4 while the panel unit 40*b* is closed.

The mode of operation of the curtain panel assembly 40 will now be described.

As shown in FIG. 4, the curtain panel 40*a* of the curtain panel assembly 40 of the game machine island 10 normally assumes a closed posture so that the interior structure of the island 10 including the distribution gutter 30 located in the upper part 20 of the support frame 20 above the individual pachinko game machines 11 is concealed so as not to be seen from outside, making the amusement arcade more tidy. The outside wall 41 of the panel unit 40*b* may be provided with an optional color to make it look more attractive.

On the other hand, for checking the status (e.g., clogged) of pachinko balls A flowing in the distribution gutter 30 or for maintenance of other interior structures of the island, the individual panel units 40*b* of the curtain panel 40*a* of the curtain panel assembly 40 can be opened separately. As shown in FIG. 2, when the lower edge 45 of the panel unit 40*b* is raised about the upper edge 43 by hand, the panel unit 40*b* will be opened.

Since the image of the distribution gutter 30 is reflected in the mirror 42*a* formed on the inside wall 42, it is possible to grasp the status of pachinko balls A in the distribution gutter 30 in the upper part 20*a* of the support frame 20 by looking into the mirror 42*a* from a lower position simultaneously with the opening of the panel unit 40b. At that time, since the mirror 42a is a concave mirror curved along the concave inside wall 42, it is possible to see the distribution gutter 30 on an enlarged scale and hence to observe the distribution gutter 30 in detail.

With this arrangement, as shown in FIGS. 1 and 2, it is possible to observe the distribution gutter 30, which is located usually at a position higher than the height of a person, simply and quickly without using small portable steps to climb up. Further, the panel unit 40b can be held in an open position by the support arms 47. When the panel unit 40b is opened, the rod-like member 49 of the support arm 47 is expanded from the tubular member 48, and the support arm 47 is kept in a fully expanded posture.

Furthermore, since it is possible to check not only the states of pachinko balls A in the distribution gutter 30 but also other interior structures of the island simply and quickly by the mirror 42a of the inside wall 42 of the opened panel unit 40b, maintenance of the inside structure of the island can take place with ease.

Also in this case, since the panel unit 40b is held in an open position by the support arms 47, it is possible to watch the distribution gutter 30 and other interior structures in the mirror 42a of the panel unit 40b for a long time without opening the panel unit 40b repeatedly, thus enabling efficient maintenance.

For closing the panel unit 40b, the lower edge 45 of the panel unit 40b is pushed upwardly by hand to cause the associated support arms 47 to construct. Since the curtain panel 40a, as shown in FIG. 1, is divided into a plurality of panel units 40b each having a horizontal length corresponding to the total width of two adjacent pachinko game machines 11, 11, it is possible to mount the curtain panel 40a on the outside of the upper part 20a of the support frame 20 easily and accurately during assembly of the game machine island 10.

Figure 5:
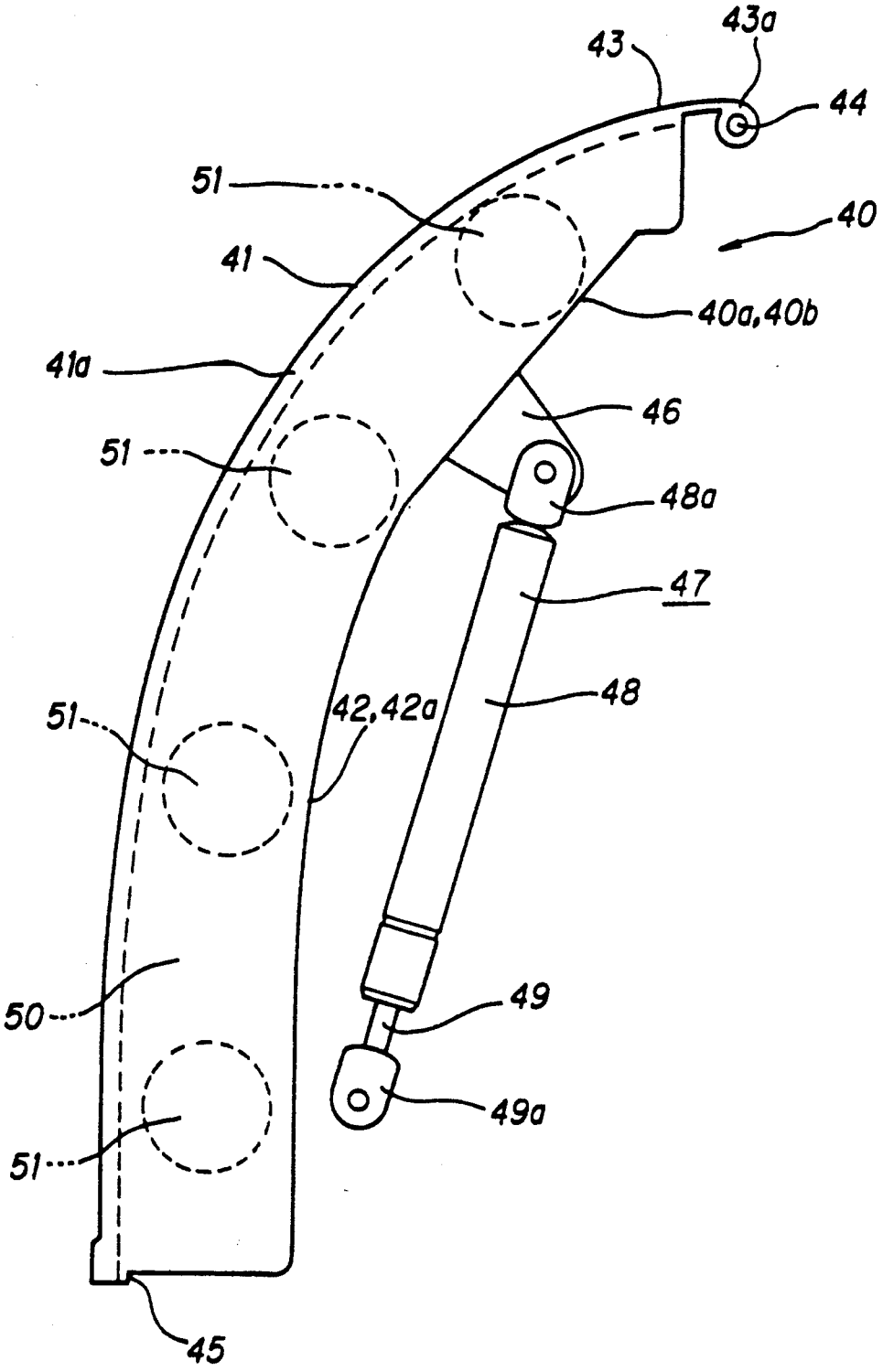
FIG. 5 is a side view of a modified panel unit according to a second embodiment of the invention.

FIG. 5 shows a second embodiment of this invention.

In this embodiment, as shown in FIG. 5, the outside wall 41 of the panel unit 40b is a transparent decorative illumination plate 41a such as of acrylic resin, there being defined between the outside and inside walls 41, 42 a hollow 50 in which an illumination source 51 such as a neon tube is located. The other construction is identical with that of the first embodiment and description thereof is therefore omitted here.

In the second embodiment, it is possible to make the game machine island 10 more attractive, thus realizing a eyecatching amusement arcade.

Although it is used in an island of pachinko machines in the foregoing embodiments, this invention may be also applied to an island of slot machines or other game machines.

According to the curtain panel assembly of this invention, partly since the upper edge of the curtain panel is pivotally mounted on the upper part of the support frame of the game machine island along the upper frame edge, and partly since there is provided on the inside wall a mirror in which the image of the interior of the island including the distribution gutter is reflected when the lower edge of the curtain panel is raised about the upper edge by opening the curtain panel, it is possible to look into the interior of the island simply and quickly for checking the states of game mediums in the distribution gutter situated in the upper part of the support frame or for maintenance of the interior structure of the island.

Further, since the curtain panel has between its upper and lower edges a curved surface bulging outwardly along which a concave mirror is provided, it is possible to see the distribution gutter and other interior structures of the island, on an enlarged scale, in the mirror so that a detailed checkup can be achieved. It is also possible to create a new appearance. Furthermore partly since the outside wall of the curtain panel is a transparent decorative illumination plate and partly since there is defined between the outside and inside walls of the curtain panel a hollow in which an illumination source is located, it is possible to make the game machine island more attractive.

In addition, since the curtain panel has the support arms for holding the curtain panel in an open position, it is possible to watch the distribution gutter and other interior structures of the island by the mirror for a long time and to do maintenance with improved efficiency. If the curtain panel is divided into a plurality of panel units each having a length corresponding to the total width of one or more successive game machines, it is possible to assemble the game machine efficiently.

What is claimed is:

1. A curtain panel assembly for concealing the interior of a game machine island including a support frame on which a plurality of game machines are mounted in array, and a distribution gutter situated in and along an upper part of the support frame and extending over the game machines, said curtain panel assembly comprising:

(a) a curtain panel adapted to be openably mounted on the upper part of the support frame at an outside thereof;

(b) said curtain panel having an upper edge adapted to be pivotally connected to an upper edge of the support frame; and (c) said curtain panel having on its inside wall surface a mirror on which the image of the interior of the island including the distribution gutter is reflected so as to be observed from outside when said curtain panel is angularly moved about the upper panel edge to open as a lower edge of said curtain panel is pulled upwardly.

2. A curtain panel assembly according to claim 1, wherein said curtain panel has a curved surface bulging outwardly as viewed in vertical cross section, said mirror is a concave mirror along the concave inside wall surface of said curtain panel.

3. A curtain panel assembly according to claim 1, wherein said curtain panel has between its inside and outside walls a hollow in which a light source is located, said mirror being positioned on said inside wall, and said outside wall being a transparent decorative illumination plate.

4. A curtain panel assembly according to claim 1, further comprising support arms for supporting said curtain panel in an open position as the lower panel is pulled upwardly to angularly move about the upper panel edge.

5. A curtain panel assembly according to claim 1, wherein said curtain panel is divided into a plurality of panel units adapted to be arranged longitudinally along the upper part of the support frame at an outside thereof in such a manner that each of said panel units corresponds to one or more of the game machines.

* * * * *